US010383362B2

(12) United States Patent
Bagwell

(10) Patent No.: US 10,383,362 B2
(45) Date of Patent: Aug. 20, 2019

(54) DABBING TOOL CONFIGURED FOR RELEASABLE ENGAGEMENT WITH A HEATED NAIL

(71) Applicant: Brian Bagwell, Marietta, GA (US)

(72) Inventor: Brian Bagwell, Marietta, GA (US)

( * ) Notice: Subject to any disclaimer, the term of this patent is extended or adjusted under 35 U.S.C. 154(b) by 0 days.

(21) Appl. No.: 16/239,437

(22) Filed: Jan. 3, 2019

(65) Prior Publication Data

US 2019/0183168 A1 Jun. 20, 2019

Related U.S. Application Data

(63) Continuation of application No. 15/406,657, filed on Jan. 13, 2017, now Pat. No. 10,182,596.

(51) Int. Cl.

| | |
|---|---|
| ***A24F 1/30*** | (2006.01) |
| ***A24F 1/00*** | (2006.01) |
| *A24F 47/00* | (2006.01) |

(52) U.S. Cl.

CPC ..... *A24F 1/30* (2013.01); *A24F 1/00* (2013.01); *A24F 47/004* (2013.01)

(58) Field of Classification Search

CPC ..... A24F 1/30

See application file for complete search history.

(56) References Cited

U.S. PATENT DOCUMENTS

| | | | | |
|---|---|---|---|---|
| RE36,193 | E | 4/1999 | Newman | |
| 5,967,147 | A | 10/1999 | Newman | |
| 6,179,864 | B1 | 1/2001 | Peters-Combs | |
| 2014/0251355 | A1* | 9/2014 | Tracey | A61F 1/30 131/328 |
| 2015/0013704 | A1 | 1/2015 | Maglione | |
| 2016/0015083 | A1 | 1/2016 | Castillo | |
| 2016/0345385 | A1* | 11/2016 | Schroeder | H05B 3/148 |
| 2017/0079324 | A1 | 3/2017 | Eksouzian | |
| 2018/0043115 | A1 | 2/2018 | Gould | |
| 2018/0160731 | A1 | 6/2018 | Zayach | |
| 2018/0177226 | A1* | 6/2018 | Royse, IV | A24F 9/06 |
| 2018/0199621 | A1 | 7/2018 | Bagwell | |

OTHER PUBLICATIONS

Notice of Allowance from related U.S. Appl. 15/406,657 dated Sep. 13, 2018, 8 pages.

* cited by examiner

*Primary Examiner* — James Harvey

(74) *Attorney, Agent, or Firm* — Kilpatrick Townsend & Stockton LLP

(57) ABSTRACT

Described is a dabbing tool for transporting a tobacco or other herbal concentrate to a heated nail of a smoking or vaporizing apparatus. The dabbing tool includes a tip portion configured to transport and apply the concentrate to the heated nail. To provide improved convenience and safety for removing, handling, and manipulating the heated nail, the dabbing tool also includes a nail holder portion configured to releasably engage with the heated nail.

17 Claims, 8 Drawing Sheets

DABBING TOOL CONFIGURED FOR RELEASABLE ENGAGEMENT WITH A HEATED NAIL

CROSS-REFERENCE TO RELATED APPLICATION

This application is a continuation application of and claims priority to U.S. patent application Ser. No. 15/406,657, filed on Jan. 13, 2017, the contents of which are incorporated herein by reference in their entirety.

FIELD OF THE INVENTION

This invention relates to a dabbing tool for use with a smoking or vaporizing apparatus having a heated nail, specifically a dabbing tool that includes one or more features for releasably engaging with the heated nail in order to facilitate safe removal, handling, or manipulation of the heated nail.

BACKGROUND

Smoking is a practice in which a substance, most commonly tobacco, is burned and the product of the combustion is inhaled. The most common method of smoking today is through cigarettes, which are primarily industrially manufactured. Many other smoking implements exist, including cigars, pipes, hookahs, water pipes and vaporizers. In some cases, the substance being consumed may contain chemical compounds that may provide short- or long-term health benefits or may be used effectively to treat diseases or other conditions. But smoking in the conventional sense, through inhalation of smoke as a byproduct of the combustion of the substance to be smoked can be hazardous to one's health due to the existence of irritating, toxic, and carcinogenic compounds in the smoke. The hazards of breathing in smoke containing harmful compounds from the combustion of tobacco or other herbal substances may, in many cases, outweigh any benefits gained through the human consumption of such substances.

One common alternative to smoking via combustion is the use of a vaporizer. Vaporization is an alternative to burning that avoids the inhalation of many irritating toxic and carcinogenic by-products of combustion. Vaporization involves the use of a concentrate of an herbal substance, which may be an oil, resin, or other extract. During vaporization, the concentrate to be vaporized is heated to a temperature below its combustion point but high enough to release active ingredients within a vapor. Little or no combustion occurs during the vaporization process, so excessive smokiness may avoided by vaporization of a concentrate to be consumed.

There are a wide variety of different apparatus available for vaping. FIG. 1 is a schematic view of an example of a rig and nail apparatus 101. During operation the nail 102 (typically a hollow pin) may be heated, for example using a torch 103 or lighter, to a high temperature sufficient to vaporize a concentrate. A dabbing tool (not shown) may be used to apply (i.e., dab) a concentrate to the heated nail 102, where it vaporizes upon contact with the heated nail 102. In this rig and nail apparatus 101, the heated nail 102 is in communication with a chamber 104 partially filled with liquid such as water. Vapor 105 from the heated nail may be drawn through the hollow nail 102 into the chamber 104. Thereafter, the vapor 105 may be inhaled through the mouthpiece 106 of the apparatus 101. Vaporized concentrate consumed through the rig and nail apparatus 101 is typically smoother and free of large droplets of water.

As described above, during operation the nail is heated to high temperatures. In some cases it is desirable to remove the nail after vaporization, for example to clear the flow path that is restricted when the nail is in place on the rig. This may be desirable to ease inhalation and clearing of the rig, for example, for individuals suffering from chronic obstructive pulmonary disease (COPD) or emphysema. Removal of the nail during operation is difficult, however, because the nail is heated to very high temperatures. In other cases, a heated nail may be dropped or fall out of the rig during operation. Picking up a heated nail from a table or floor may be difficult while the temperature of the nail remains elevated, creating a risk of burns and a fire hazard. Accordingly, there is a need for an apparatus to facilitate safe removal, handling, and manipulation of the heated nail during operation of the rig.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Versions of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain cases, a dabbing tool includes: a body portion; a tip portion configured to transport a concentrate to a heated nail; and a nail holder portion configured to releasably engage with a heated nail. The nail holder portion may include a hook, a pair of fingers, or a clamp. The nail holder portion further may form an opening configured to receive a heated nail having a diameter between about 14 mm and about 15 mm.

According to certain cases, an assembly of a nail and a dabbing tool includes: a nail for vaporizing or combusting a concentrate when heated and a dabbing tool. The nail includes a cylindrical neck portion and the dabbing tool includes a nail holder portion configured to releasably engage with the neck portion of the nail. The nail holder portion may include a hook, a pair of fingers, or a clamp. The nail holder portion further may form an opening configured to receive a heated nail having a diameter between about 14 mm and about 15 mm.

According to certain cases a method of smoking a concentrate includes: heating a nail; dabbing a concentrate onto the heated nail using a dabbing tool, the dabbing tool including a tip portion configured to transport the concentrate to the heated nail; and removing the heated nail using the dabbing tool, the dabbing tool including a nail holder portion configured to releasably engage with the heated nail. The nail holder portion may include a hook, a pair of fingers, or a clamp. The nail holder portion further may form an opening configured to receive a heated nail having a diameter between about 14 mm and about 15 mm.

BRIEF DESCRIPTION OF THE DRAWINGS

Illustrative embodiments of the present disclosure are described in detail below with reference to the following drawing figures.

DETAILED DESCRIPTION

The subject matter of versions of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Although different reference numbers are used in various drawings, any of the features shown or described in relation to any of the drawings may be included, combined, substituted, or omitted to provide additional examples.

Figure 1:
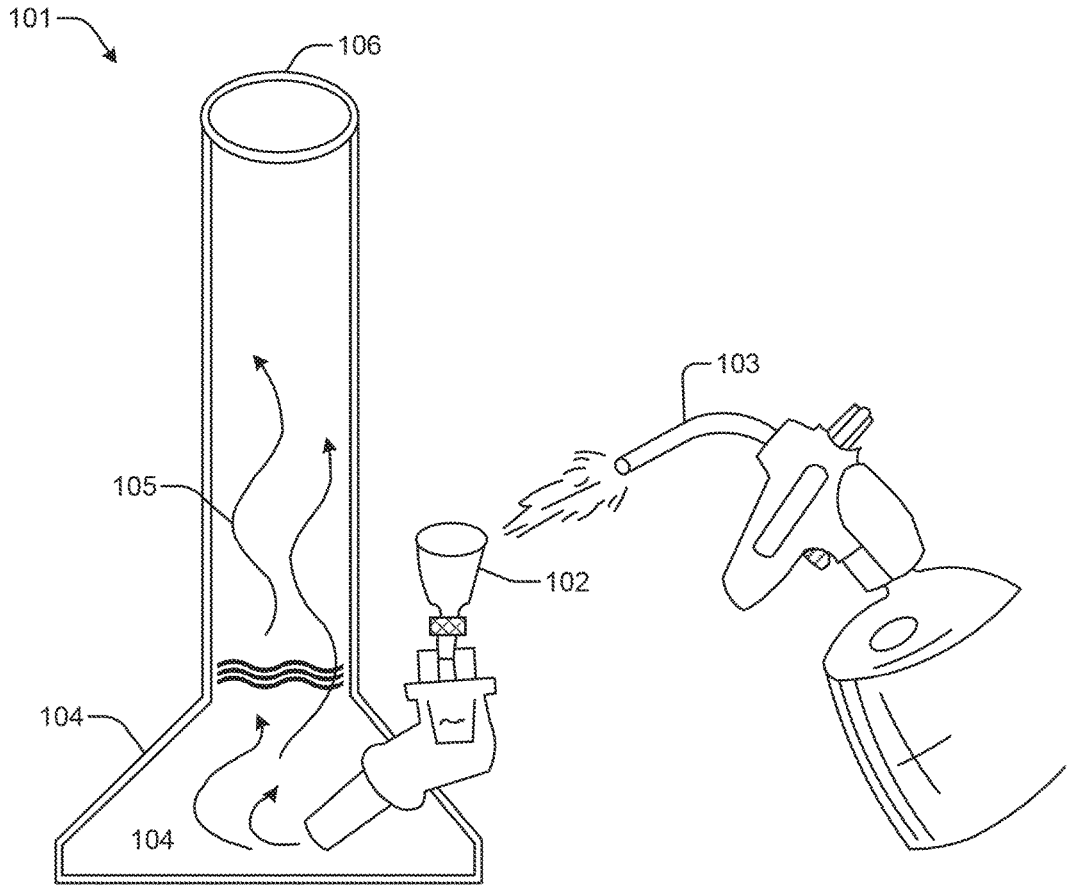
FIG. 1 (Prior Art)
FIG. 1 is a schematic view of one example of a rig and nail apparatus.
Figure 2A:
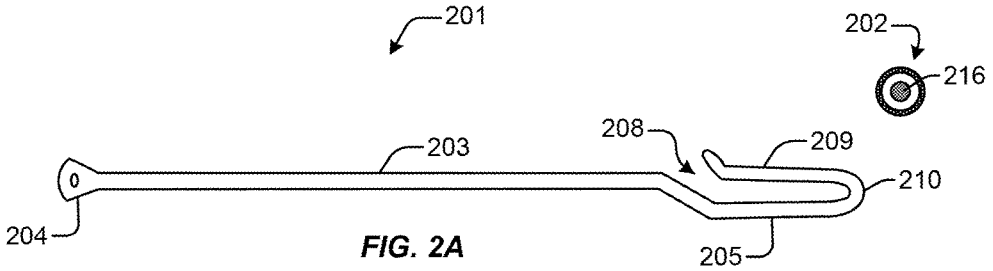
FIG. 2A is a top view of one example of a dabbing tool and a nail.
Figure 2B:
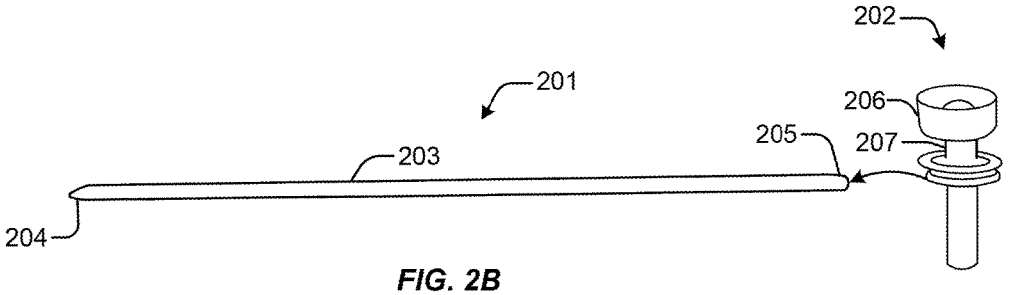
FIG. 2B is a side view of the dabbing tool and nail of FIG. 2A.

FIGS. 2A and 2B depict non-limiting examples of an assembly of a dabbing tool 201 and a nail 202. The dabbing tool 201 may have a body portion 203, a tip portion 204 and a nail holder portion 205. The tip portion 204 and nail holder portion 205 of the dabbing tool 201 may be located at opposite ends of the body portion 203. In certain embodiments, the dabbing tool 201 may be formed, at least in part, from titanium, stainless steel, quartz, or ceramic. The nail 202 may be formed, in certain embodiments, of titanium, stainless steel, quartz, or ceramic. The dabbing tool 201 and nail 202 may be formed of the same material or different materials.

The nail 202 may include a hollow bore 216 and may interface with an inlet, for example an inlet stem, of a dabbing rig. The nail 202 may include a cylindrical head portion 206 and a cylindrical neck portion 207, with the hollow bore 216 extending from the head portion 206 through the length of the neck portion 207 to an opening (not shown) at the lower end of the neck portion 207, forming a passageway from the head portion 206 into the inlet of the dabbing rig when the neck portion 207 is inserted into the inlet stem of the dabbing rig. The head portion 206 may have a larger diameter than the neck portion 207. The neck portion 207 may have a diameter of between about 14 mm and about 15 mm. In certain embodiments, the neck portion 207 may have a diameter of about 14.5 mm.

The body portion 203 of the dabbing tool 201 may be elongated to facilitate holding and using the dabbing tool 201. In certain embodiments, at least part of the body portion 203 may be thermally insulated from the nail holder portion to limit the amount of heat transfer from the heated nail to the hand of a person using the dabbing tool. For example, the body portion 203 may include a rubber or polymeric covering to thermally insulate the body portion 203 from any heat-conducting portions of the apparatus. In some instances, whether insulated or not, the body portion 203 may be of a sufficient size and/or length to facilitate heat dissipation from the dabbing tool.

The tip portion 204 may be located at an end portion of the dabbing tool 201 and may be configured in a suitable manner to transport a concentrate to the heated nail 202. The concentrate may include, for example a tobacco concentrate or other herbal concentrate. In certain embodiments, the concentrate may comprise an oil, a resin, or other extract.

As shown in FIGS. 2A and 2B, the tip portion 204 may be configured as a spatula configured to facilitate manipulation of a concentrate. In alternative embodiments, the tip portion may include a scoop, a point, a hook, a forked end, or any other suitable configuration. In other embodiments, the tip portion of the dabbing tool may be configured to receive interchangeable tips having different shapes. For example, the body portion 203 may include a threaded portion configured to engage with a threaded portion of the tip portion to facilitate changing tips having different shapes.

During operation of the rig, the head portion 206 of the nail 202 may be heated, for instance using a torch or lighter. The nail 202 may be heated to a temperature sufficient to vaporize the concentrate. In some cases, the nail 202 may be heated to a temperature sufficient to combust the concentrate. The tip portion 204 may be used to apply (i.e., dab) a concentrate to the head portion 206 of the heated nail 202. The product of vaporization and/or combustion may be drawn through the hollow bore 216 of the nail 202 and through the inlet stem of the rig into a chamber containing water. Thereafter, the product of vaporization or combustion may be inhaled through a mouthpiece of the rig.

The nail holder portion 205 of the dabbing tool 201 may be configured to releasably engage with the heated nail 202. The nail holder portion 205 may form an opening 208 configured to receive the heated nail 202. In some cases, the opening may be dimensioned to receive a neck portion 207 of a heated nail 202 having a diameter between about 14 mm and about 15 mm. In some cases, the opening may be dimensioned to receive a heated nail having a diameter of about 14.5 mm. In some cases, the opening may be about 15 mm wide.

The nail holder portion 205 may be configured to form a hook 209. The hook may include a U-shaped portion 210. The hook may further include an opening 208 set at an angle to the U-shaped portion. During use, the neck portion 207 of the heated nail 202 may be received through the opening 208 and the heated nail 202 may be secured within the U-shaped portion 210 of the nail holder portion 205. Securing the heated nail 202 within the nail holder portion 205 facilitates safe removal, handling, and manipulation of the heated nail during operation of the rig. For example, the heated nail may be removed after vaporization of the concentrate to ease inhalation and clearing of the rig, for example, for individuals with limited lung capacity such as those suffering from emphysema or COPD. Alternatively, in the event that the heated nail falls out of the rig or is dropped by a user during operation of the rig, securing the heated nail 202 using the nail holder portion 205 may reduce the risks of burns or fire and may facilitate safe handling and manipulation of the heated nail 202. Advantageously, the embodiment depicted in FIGS. 2A and 2B includes both a tip portion 204 configured to transport a concentrate to a heated nail 202 and a nail holder portion 205 configured to handle and manipulate the heated nail 202, thereby avoiding the need for separate tools for transporting a concentrate to the heated nail and for handling or manipulating the heated nail 202.

Figure 3:
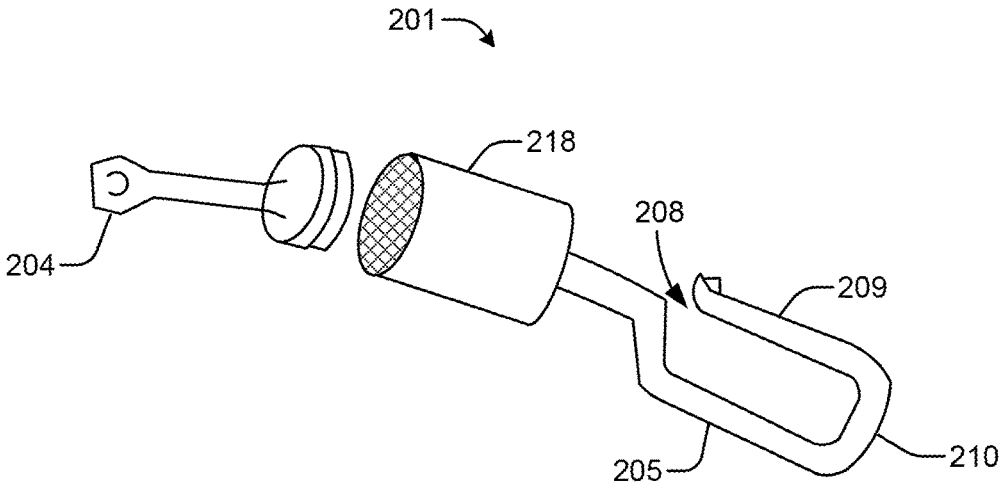
FIG. 3 is a top view of an example of a dabbing tool with an integrated container.

In addition to those features depicted in FIGS. 2A and 2B, in some cases the dabbing tool 201 may further include a container 218, for example as depicted in FIG. 3. The container 218 may be formed integrally with the body or alternatively may be attached to the dabbing tool 201. The container may be configured to store one or more concentrates. The container may be lined with a non-stick material, such as polytetrafluoroethylene (PTFE or Teflon). The container alternatively or additionally may be configured to store one or more interchangeable tips for the dabbing tool 201.

Figure 4A:
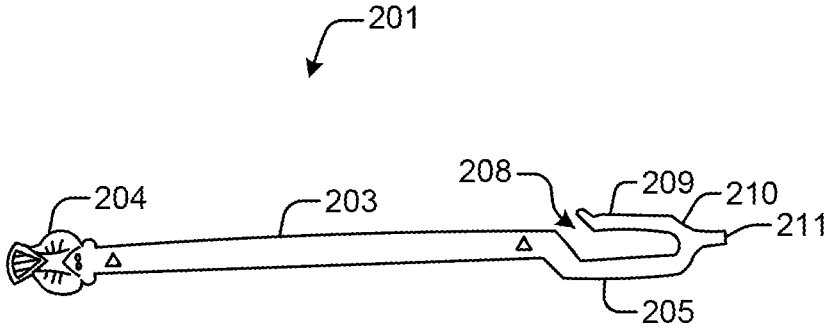
FIG. 4A is a top view of another example of a dabbing tool.
Figure 4B:
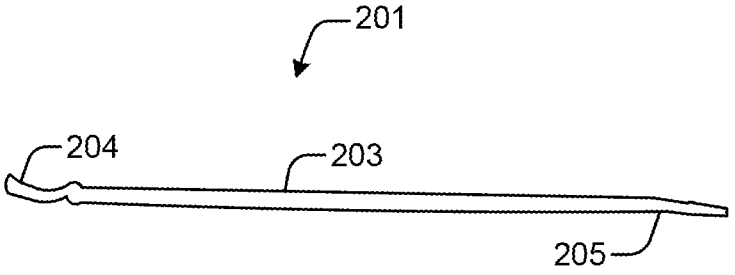
FIG. 4B is a side view of the dabbing tool of FIG. 4A.

FIGS. 4A and 4B show alternative examples of a dabbing tool 201 of the present application. The dabbing tool 201 may include a tip portion 204 that is configured as a scoop for transporting a concentrate to a heated nail. FIGS. 4A and 4B further show examples of a dabbing tool 201 that includes an alternate tip portion 211 formed integrally with the nail holder portion 205. The alternate tip portion may be configured as a spatula or other suitable shape. During use of a dabbing tool 201 according to the embodiment depicted in FIGS. 4A and 4B, a concentrate may be applied to a heated nail using the tip portion 204 or the alternate tip portion 211 integrated with the nail holder portion 205. The nail holder portion 205 may be used to remove, handle, or manipulate the heated nail without reversing the orientation of the dabbing tool 201. In other embodiments, a dabbing tool may include only a tip portion integrated with a nail holder portion without including a separate tip portion located at the opposite end of the body of the dabbing tool. In such an alternative embodiment, the dabbing tool may include a decorative element, such as an action figurine, at an end of the body of the dabbing tool.

Figure 5:
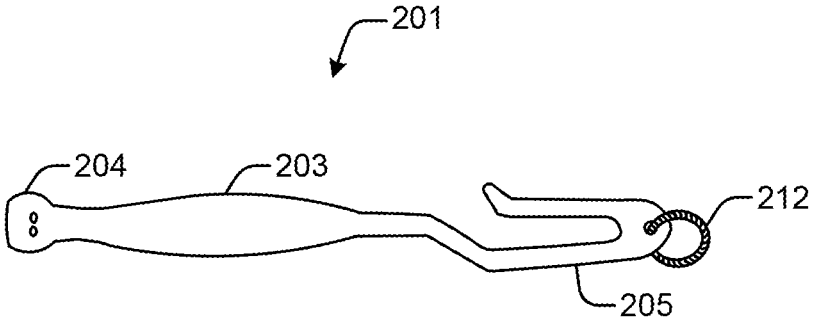
FIG. 5 is a top view of another example of a dabbing tool.

FIG. 5 shows an alternative example of a dabbing tool 201 of the present application. The dabbing tool 201 includes a body portion 203, a tip portion 204 and a nail holder portion 205. The nail holder portion further includes a keychain loop 212. The keychain loop 212 may facilitate attachment of the dabbing tool 201 to a keyring or to a user's clothing, for example. In alternative embodiments, the keychain loop 212 may be formed as part of the body portion 203 or tip portion 204 of the dabbing tool 201.

Figure 6A:
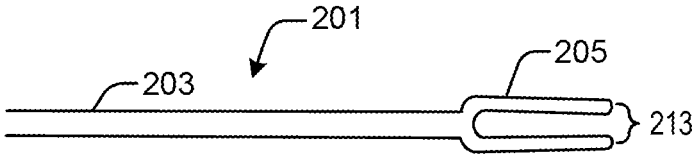
FIGS. 6A to 6D are examples of nail holder configurations for a dabbing tool.
Figure 6B:
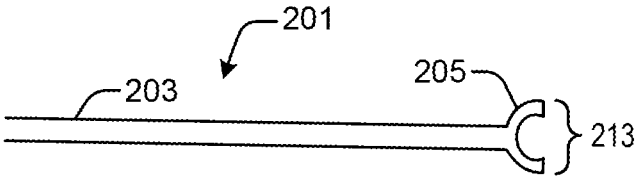
Figure 6C:
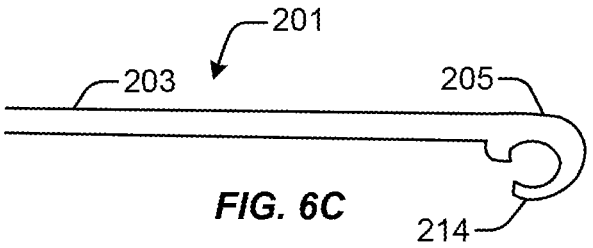
Figure 6D:
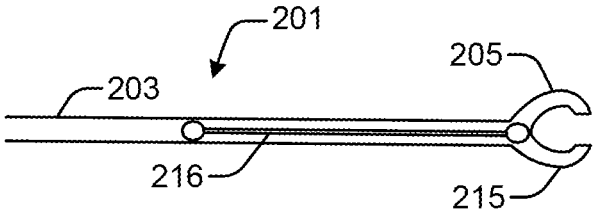

FIGS. 6A, 6B, 6C, and 6D show alternative nail holder portions 205 of dabbing tools 201 of the present application. Each of the nail holder portions 205 shown in FIGS. 6A to 6D are configured to releasably engage with a heated nail. Each of the nail holder portions 205 forms an opening configured to receive a heated nail. In certain embodiments, the opening may be between about 14 mm and about 15 mm. FIG. 6A shows a dabbing tool 201 having a body portion 203 and a nail holder portion 205. The nail holder portion 205 includes a pair of fingers 213 foiling a fork. An opening is formed between the pair of fingers 213 to receive a heated nail. FIG. 6B shows a dabbing tool 201 having a body portion 203 and a nail holder portion 205. The nail holder portion 205 includes a pair of fingers 213 forming a U-shape. An opening is formed between the pair of fingers 213 to receive a heated nail. FIG. 6C shows a dabbing tool 201 having a body portion 203 and a nail holder portion 205. The nail holder portion 205 is configured to form an annular hook 214. The hook 214 is configured to include an opening which may receive a heated nail. FIG. 6D shows a dabbing tool 201 having a body portion 203 and a nail holder portion 205. The nail holder portion 205 includes a clamp 215. The clamp 215 may be opened and closed, for example, using a slide 216. The clamp is configured to releasably engage with a heated nail.

Figure 7A:
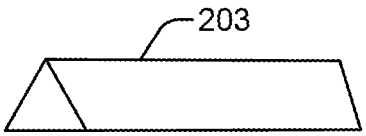
FIGS. 7A to 7D are sectional views showing examples of cross sectional shapes for dabbing tool shafts.
Figure 7B:
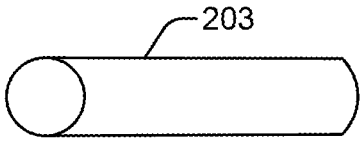
Figure 7C:
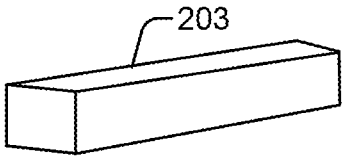
Figure 7D:
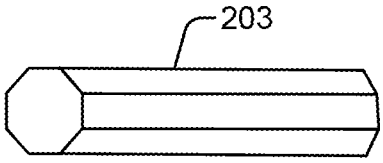

FIGS. 7A, 7B, 7C, and 7D show cross sectional views of shafts of dabbing tools according to certain aspects of the present application. FIG. 7A shows a body portion 203 of a dabbing tool having a triangular cross-section. FIG. 7B shows a body portion 203 of a dabbing tool having a circular cross-section. FIG. 7C shows a body portion 203 of a dabbing tool having a square cross-section. FIG. 7D shows a body portion 203 of a dabbing tool having an octagonal cross-section. In alternative embodiments, a dabbing tool may have any suitable sectional profile to facilitate holding and using the dabbing tool.

Figure 8:
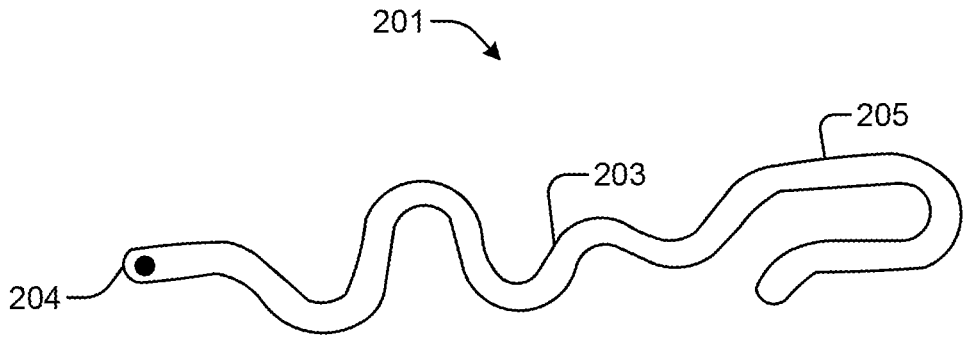
FIG. 8 is a top view of another example of a dabbing tool.

FIG. 8 shows an alternative example of a dabbing tool 201 of the present application. The dabbing tool 201 includes a body portion 203, a tip portion 204 and a nail holder portion 205. The body portion 203 is formed in a serpentine shape. The serpentine shape may, for example, reduce the transfer of heat to the hand of a user.

Different arrangements of the components depicted in the drawings or described above, as well as components and steps not shown or described are possible. Similarly, some features and sub-combinations are useful and may be employed without reference to other features and sub-combinations. Cases of the invention have been described for illustrative and not restrictive purposes, and alternative cases will become apparent to readers of this patent. Accordingly, the present invention is not limited to the cases described above or depicted in the drawings, and various cases and modifications may be made without departing from the scope of the claims below.

That which is claimed is:

1. A dabbing tool comprising:

a tip portion configured to transport a concentrate to a heated nail;

a nail holder portion configured to releasably engage with a heated nail; and a loop connector.

2. The dabbing tool of claim 1, wherein the loop connector comprises a keychain loop.

3. The dabbing tool of claim 2, wherein the tip portion comprises the keychain loop.

4. The dabbing tool of claim 2, wherein the nail holder portion comprises the keychain loop.

5. The dabbing tool of claim 1, wherein the nail holder portion forms an opening configured to receive a heated nail having a diameter between about 14 mm and about 15 mm.

6. The dabbing tool of claim 1, wherein the nail holder portion comprises a hook.

7. The dabbing tool of claim 6, wherein the hook comprises a U-shaped portion.

8. The dabbing tool of claim 1, wherein the nail holder portion comprises a pair of fingers.

9. The dabbing tool of claim 1, wherein the nail holder portion comprises a clamp.

10. The dabbing tool of claim 1, wherein the tip portion comprises a spatula.

11. The dabbing tool of claim 1, wherein the tip portion comprises a scoop.

12. The dabbing tool of claim 1, wherein the tip portion is configured to receive interchangeable tips having different shapes.

13. The dabbing tool of claim 1, further comprising a container configured to store one or more of a concentrate and an interchangeable tip.

14. The dabbing tool of claim 1, wherein the tip portion is formed on the nail holder portion.

15. The dabbing tool of claim 1, further comprising a body portion.

16. The dabbing tool of claim 15, wherein the body portion is elongated and the tip portion and the nail holder portion are formed at opposite ends of the elongated body portion.

17. The dabbing tool of claim 15, wherein at least part of the body portion is thermally insulated.

* * * * *